US006089545A

United States Patent [19]

Norman et al.

[11] Patent Number: 6,089,545

[45] Date of Patent: Jul. 18, 2000

[54] CONVERTER FOR CONVERTING A CONVENTIONAL CAR JACK INTO A TRANSMISSION JACK

[76] Inventors: Edward E. Norman, Rte. 1, Box 199-A, Verona, Mo. 65769; Cody W. Epperly, HCR 64, Box 6757, Cassville, Mo. 65625

[21] Appl. No.: 09/122,491

[22] Filed: Jul. 24, 1998

Related U.S. Application Data

[60] Provisional application No. 60/053,706, Jul. 25, 1997.

[51] Int. Cl.[7] ..... B66F 3/00

[52] U.S. Cl. ..... 254/134; 254/133 R; 254/DIG. 16; 254/131; 254/2 B

[58] Field of Search ..... 254/134, 133 R, 254/131, 16 R, 2 B, 124, DIG. 16; 269/17

[56] References Cited

U.S. PATENT DOCUMENTS

| | | | |
|---|---|---|---|
| 2,747,837 | 5/1956 | Turner | 254/134 |
| 2,748,459 | 6/1956 | Orr | 254/134 |
| 2,838,278 | 6/1958 | Johnsen | 254/134 |
| 3,958,793 | 5/1976 | Garate | 254/DIG. 16 |
| 4,133,514 | 1/1979 | Anderson | 254/124 |
| 4,166,608 | 9/1979 | Schelle | 254/133 R |
| 4,445,667 | 5/1984 | Webb | 254/DIG. 16 |
| 4,523,743 | 6/1985 | Wang | 254/93 H |
| 4,533,127 | 8/1985 | Hawkins | 269/17 |
| 4,549,722 | 10/1985 | Gagliano | 254/DIG. 16 |
| 4,558,848 | 12/1985 | Rutter | 254/100 |
| 4,829,856 | 5/1989 | Reynolds | 81/52 |
| 4,913,402 | 4/1990 | McJunkin, Jr. | 254/93 R |
| 5,156,238 | 10/1992 | Matthews | 187/8.72 |
| 5,181,821 | 1/1993 | King, Sr. | 254/133 R |
| 5,267,462 | 12/1993 | Pijanowski | 72/392 |
| 5,769,397 | 6/1998 | Dhein | 254/134 |

OTHER PUBLICATIONS

"Installer" Product Catalog. Spring & Summer 1997. pp. 12–14 and 48–49.

"Northern Hydraulic" Product Catalog. Summer 1997. p. 155.

*Primary Examiner*—David A. Scherbel
*Assistant Examiner*—Lee Wilson
*Attorney, Agent, or Firm*—Jonathan A. Bay

[57] ABSTRACT

A converter allows a user to convert a conventional car jack from a non-specialized, general service variety into a specialty transmission jack. The car jack has a low, wheeled frame; a handle; a boom extending between a base end pivoted to the frame near the handle and an opposite end formed with a seat portion; and a hydraulic cylinder stretching between the frame and the boom which is actuated by pumping the jack handle to raise the boom. The seat portion of the boom is formed with a socket. The car jack conventionally is provided with a conventional cup having a stem which allows removable seating in the socket of the jack's boom. The converter head has a base plate defining a plane; a stem beneath the base plate for removable seating in the socket of the jack's boom; four or so arms extending between a butt end and a tip end; and cap screws threaded through the tip end of each arm. The cap screws allow adjustment in length and provide upper contact ends for propping a vehicle transmission thereon. The arms have slots in them and are bolted to the base plate by these slots such that the tip ends can be adjustably moved and locked into located in various positions substantially in the plane of the base plate. Wherein swapping back and forth between the cup and the converter head allows conversion of the jack into the specialty transmission jack.

6 Claims, 4 Drawing Sheets

CONVERTER FOR CONVERTING A CONVENTIONAL CAR JACK INTO A TRANSMISSION JACK

CROSS-REFERENCE TO PROVISIONAL APPLICATION(S)

This application claims the benefit of U.S. Provisional Application No. 60/053,706, filed Jul. 25, 1997.

BACKGROUND OF THE INVENTION

1. Field of the Invention

The invention relates to car jacks (or service jacks) and, more particularly, to a replacement- or converter-head for converting the conventional car or service jack into a specialty transmission jack. Additional aspects and objects of the invention will be apparent in connection with the discussion further below of preferred embodiments and examples.

2. Prior Art

To date, a worker dropping a transmission has the practical choice of either using a specialty transmission jack or doing without. Whereas transmission jacks have specially-configured heads that sufficiently prop a dismounted transmission, it is not practical to "make do" with other-type heads which are not specially adapted for the purpose of transmissions. The contact between such other-type heads and a dismounted transmissiomn is just too precarious to rely on. Purportedly, some workers who do not have access to a specialty transmission jack will, after loosening a transmission from its mount, allow these things to drop on their chest, and then scoot themselves out from underneath the vehicle.

Specialty transmission jacks are relatively expensive. Example prices for comparison here are selected from products offered by Lincoln Electric, of Cleveland, Ohio. It currently offers a 2-ton capacity, hydraulic service jack for $279.95 (i.e., part no. 93642). In contrast, it offers a ½-ton capacity, hydraulic transmission jack for $599.00 (i.e., part no. 93716).

In other words, a specialty transmission jack costs more than twice a conventional service jack having four times the lifting capacity. And the conventional service jack can more easily cost-justify its purchase because it is so much more useful at various other jobs than being job-specific for transmission work only. This price differential causes many small service businesses and "do-it-yourself" individuals to do without specialty transmission jacks for transmission work because they cannot afford or cost justify the equipment at that cost.

What is needed is an improvement which overcomes the shortcomings of the prior art and provides workers in the field with more affordable transmissions jacks.

SUMMARY OF THE INVENTION

It is an object of the invention to allow workers to rig up a specialty transmission jack at improved economy.

It is another object of the invention to provide a replacement- or converter-head for a conventional service jack for converting it into a specialty transmission jack, it being the affordability of the converter head that provides the previously mentioned economy.

These and other aspects and objects are provided according to the invention in a convertible hydraulic jack combination. Such a combination includes a low-clearance hydraulic jack. The jack is likely characterized by the following features: ie., a low, wheeled frame; a handle operatively connected to the frame near one end thereof; a boom extending between a base end pivoted to the frame near the handle connection and an opposite end formed with a seat portion; and a hydraulic cylinder which stretches between the frame and the boom nearly coextensively with the boom and which is actuated by pumping the jack handle to raise the seat portion of the boom; wherein the seat portion is formed with a socket.

The combination also includes a cup that has a stem for removable seating in the socket of the seat portion.

The inventive combination additionally includes an inventive converter head. This converter head has some of the following features: ie., a base plate defining a plane; a stem suspended beneath the base plate for removable seating in the socket of the seat portion; a plurality of arms, each extending between a butt end and a tip end; lockable-adjustable means for adjustably mounting the arms to the base plate such that the tip ends can be located in various positions substantially in the plane of the base plate and for locking the arms in position; and a finger carried by the tip end of each arm, each finger providing an upper contact end for propping a vehicle transmission thereon.

Wherein, swapping back and forth between the cup and the converter head allows a user to convert the jack reversibly between a non-specialized, general service variety into a specialty transmission jack.

Preferably the inventive converter head is configured such that the fingers thereof are given a reversible-foreshortening adjustability for reversibly foreshortening the length of the fingers. One way to attain this may have the arms comprising bar stock, the fingers comprising cap screws, and the reversible-foreshortening adjustability being achieved as threaded holes at the tip ends of the arms in which the cap screws are inserted. Given the foregoing, twisting any cap screw changes the length of that finger.

Preferably the inventive converter head is also configured for arm adjustability such that, each arm comprises bar stock formed with a central slot therein, and the lockable-adjustable means thereof comprises threaded-holes formed in the base plate and bolts extending through the slots of the bars and inserted in the threaded holes of the base plate for tightening and locking the bars in place. In at least one version of the converter head the base plate thereof is provided with four arms.

To turn to the cup, it comprises an enlarged-size dish head from which the stem thereof is suspended.

Preferably the base plate —given that it has lateral left and right edges —each of these left and right edges is formed with means for securing a chain. That way such a chain can be looped around a waist of a transmission propped by the fingers of the converter head, the chain being secured at opposite places by the chain securing means.

Optionally this chain-securing means comprises eyes formed in the base plate and one of bolts or hooks extending through the eyes for inserting through links of the chain. A further convenience would be achieved if the base plate were formed with a pair of bent down flanges, one each at the lateral left and right edge respectively of the base plate. That way the eyes could be formed in these bent down flanges.

These and other aspects and objects of the invention will be apparent in connection with the present discussion of preferred embodiments and examples

BRIEF DESCRIPTION OF THE DRAWINGS

There are shown in the drawings certain exemplary embodiments of the invention as presently preferred. It should be understood that the invention is not limited to the embodiments disclosed as examples, and is capable of variation within the scope of the appended claims. In the drawings.

DETAILED DESCRIPTION OF THE PREFFERED EMBODIMENTS

Figure 1:
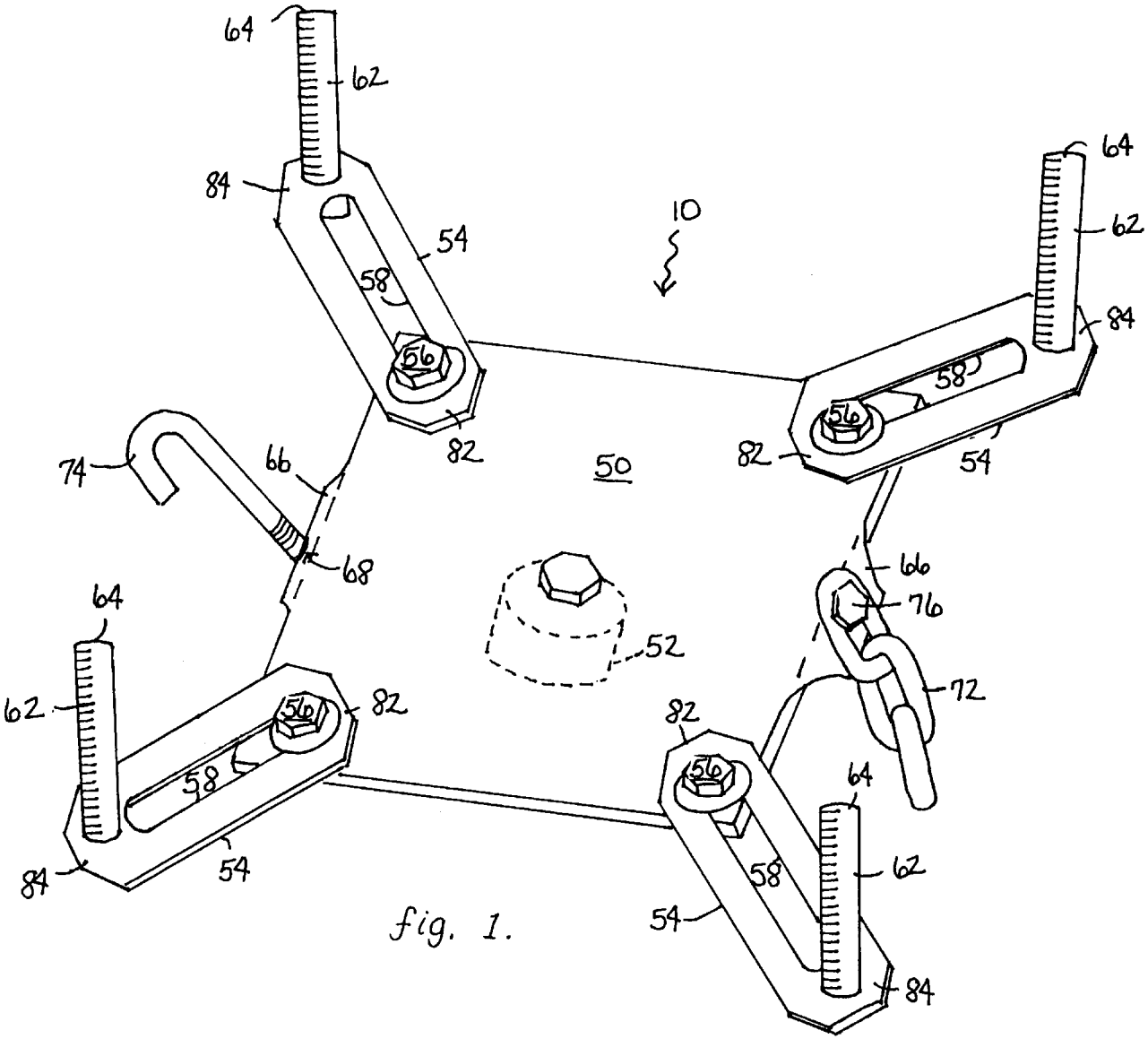
FIG. 1 is a perspective view of a converter (or "converter head") in accordance with the invention, for converting a conventional car (or "service") jack into a specialized transmission jack.
Figure 2:
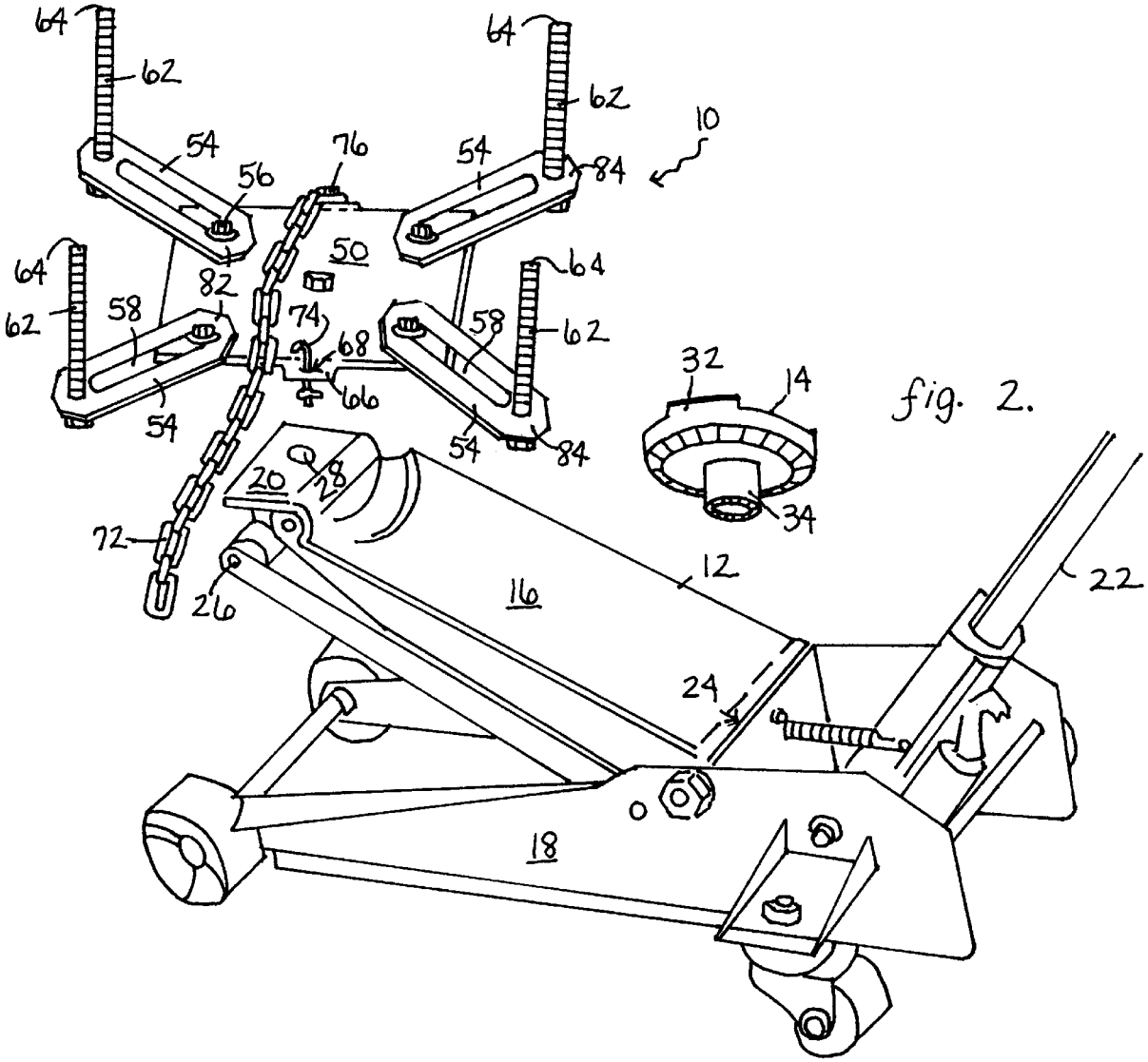
FIG. 2 is a reduced scale perspective view of the converter head of FIG. 1, as depicted unnaturally levitated for a direct-from above landing onto the seat-portion of the boom of a conventional service jack, wherein the cup that is conventionally seated on the boom is shown unseated and laid aside on the ground.

FIGS. 1 and 2 show a converter (or "converter head") 10 in accordance with the invention, for converting a conventional car (or "service") jack 12 into a specialized transmission jack. FIG. 2 shows the converter head 10 unnaturally levitated above a conventional service jack 12 for a direct-from above landing on the seat portion 20 of the boom 16 of the service jack 12.

The service jack 12 is illustrated here as representative of various common widely-available service jacks of the prior art. More particularly, this illustrated service jack 12 is of a conventional low-clearance type of hydraulic jack having a low wheeled frame 18, the boom 16, a handle 22, and a hydraulic cylinder (hidden from view by the boom which overlies it). The boom 16 comprises a four-bar linkage system as is known in the art.

The handle 22 is elongated and is pivotably connected to the frame 18 near a back end of the frame. The boom 16 has a base end 24 pivoted to the frame 18 at a rearward position thereon, next to but forward of the handle connection. From its base end 24, the boom 16 extends forwardly to an opposite or "lift" end 26, which is formed with the seat portion 20. The seat portion 20 is formed with a socket 28 for the mounting or seating of a conventional cup 14 which is provided with these kinds of jacks (the conventional cup 14 is shown unseated and lying on the ground).

Extending beneath the boom 16 (and hidden from view thereby) is the hydraulic cylinder. The hydraulic cylinder and its extensible ram (neither in view) stretch between a pinned-connection to the frame 18 at a location near the boom 16's base-end 24 connection, and an opposite pinned-connection to the boom 16 at a location under the boom 16's seat portion 20. Extension of the hydraulic cylinder's ram (not shown) is actuated by up and down pump strokes of the jack handle 22, and this raises the seat portion 20 of the boom 16. Retraction of the hydraulic cylinder's ram (again, not in view) can be achieved in various ways, including by a hand-twisted bleed valve (also not in view) and the like, and this drops the seat portion 20.

The conventional cup 14 has a broad head 32 and a stem 34 suspended underneath the head 32 for seating in the socket 28 of the boom 16's seat portion 20. The cup 14 is shown unseated in FIG. 2, as dismounted and resting on the ground beside the jack 12 in a non-use position.

FIG. 2 shows the converter 10 in accordance with the invention in an unnaturally levitated position above the seat portion 20 of the jack 12, which is where a person would hold it just before seating it onto the jack 12 for use. Swapping back and forth between the conventional cup 14 and the converter head 10 in accordance with the invention allows a user to convert the jack 12 from a non-specialized, general service variety into a specialty transmission jack, and vice versa, at will.

Figure 3:
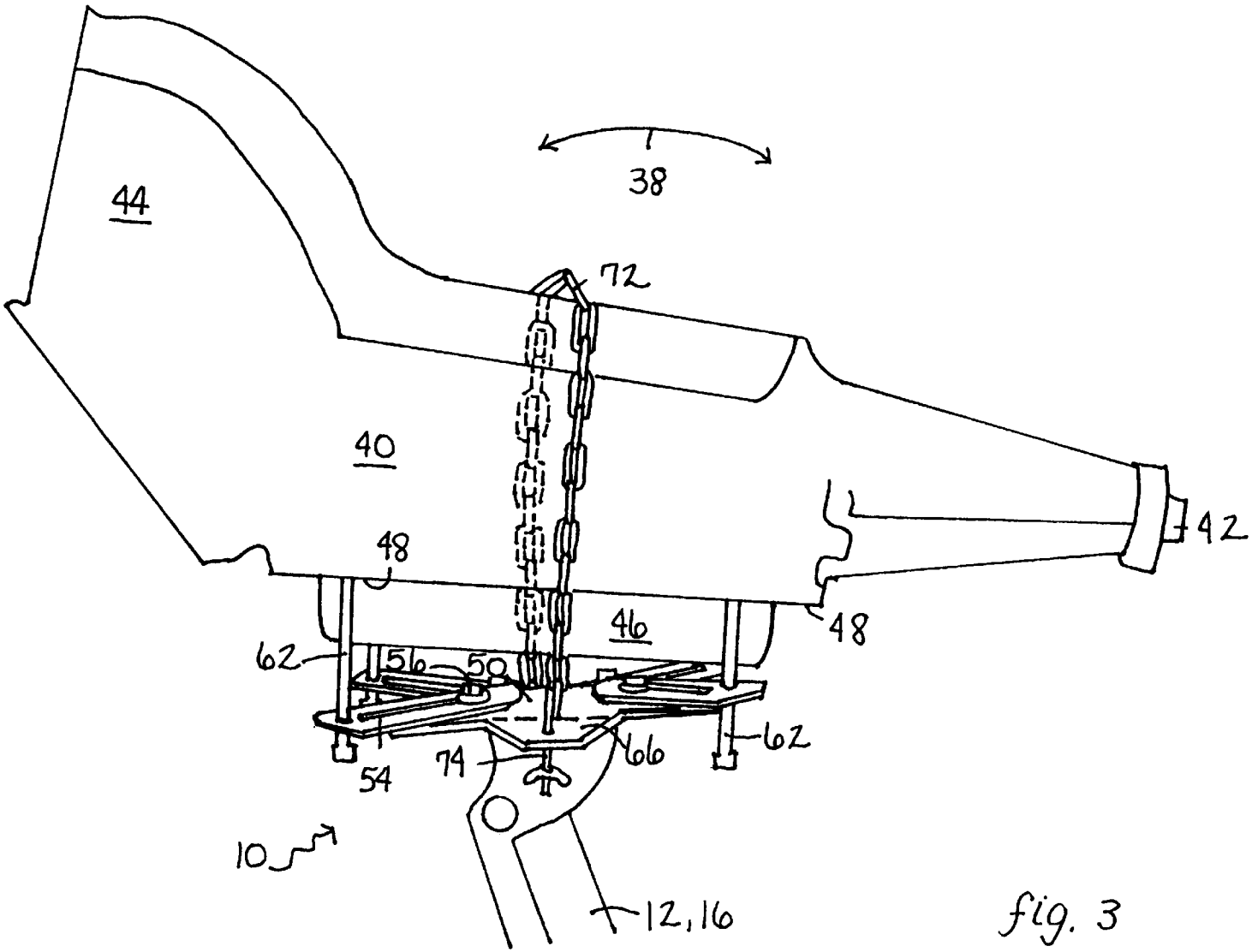
FIG. 3 is a further reduced scale, side perspective view of the converter head in accordance with the invention, as seated on the boom of the service jack and shown in use supporting a transmission of the automatic variety for a two-wheel drive (2WD) vehicle (not shown) to illustrate one operative use environment for the invention, wherein the bell housing of the transmission is to the left in the view and the tail shaft is to the right.

FIG. 3 shows use of the converter 10 and jack 12 combination in accordance with the invention. In FIG. 3, the converter 10 and jack 12 combination is shown supporting a vehicle transmission 40 of the automatic variety for a two-wheel drive (hereinafter, "2WD") vehicle (not shown). This transmission 40 extends between a tail shaft 42 on the extreme right in the view, and a bell housing 44 that progressively flares out wider in the right to left direction such that at the extreme left, the bell housing 44 may measure between about twenty and twenty-four inches (50 and 69 cm) wide or so.

Turning back to FIGS. 1 and 2, the converter 10 has four upwardly extending fingers 62 that terminate in prop ends 64 (see, eg., FIG. 1) or contact surfaces that abut or rest under the underside of the transmission 40. These fingers 62 comprise cap screws inserted through threaded holes near the outer ends of each arm 54. The cap screws 62 are adjusted in this instance to incline or tilt the transmission relatively level. If the transmission 40 were tipped with the bell housing 44 relatively down (this is not shown), this sort of tipping or tilting would give the bell housing 44 a slightly lower profile and improve the ability of the bell housing 44 to duck under of clear beneath the chassis of the vehicle from which the transmission 40 is being dropped (or installed) (also, no vehicle is shown).

FIG. 3 also includes an arrow indicated as 38 which shows one of the arcs of along which tilt that can be given to the transmission 40 by adjusting the cap screws 62. That is, the arrow 38 indicates that the transmission 40 can be tipped forwardly or tilted rearwardly as by adjusting the forward pair or rearward pair of cap screws 62 respectively. In fact, the transmission 40 can be effectively gimbaled in all directions by appropriately adjusting the cap screws 62 up and down relative to each other. The transmission 40 is propped relatively stable on the converter 10 but prudence dictates belting the transmission around the waist with a safety chain 72.

Since the transmission 40 shown in the drawing is representative of an automatic transmission for a 2WD vehicle, it has an oil pan 46. The fingers 62 of the converter 10 which support the transmission are spread around this oil pan 46 and carry the transmission 40 by the gasket perimeter 48 which surrounds the oil pan 46. The fingers 62 are arranged this away because, for one thing, it is desirable not to carry the weight of the transmission 40 by the oil pan 46, and for another, it is highly desirable to support the weight of the transmission 40 by the fingers 62 resting in the gasket perimeter 48. The gasket perimeter 48 is sufficiently strong for this purpose but the oil pan 46 is not.

Although not shown, the converter 10 and jack 12 combination in accordance with the invention are equably adaptable for use supporting a manual transmission of a four-wheel drive (hereinafter, "4WD") vehicle (not shown). A manual 4WD transmission (not shown) differs from an automatic 2WD transmission (indicated as 40 in FIG. 3) at least in that the manual 4WD transmission includes a transfer case, a transmission-to-transfer case coupler or adapter, and a cross member extending laterally to either side beneath the coupler or adapter. Hence 4WD transmissions are comparatively heavy. On the brighter side, there are numerous more nooks or crannies and crevices to rest the fingers 62 in on the bottom of a 4WD transmission than with an ordinary 2WD transmission. Propping a manual 4WD transmission requires adjusting the fingers 62 as appropriate to contact the transmission in suitable places (again, of which there are many).

Figure 4:
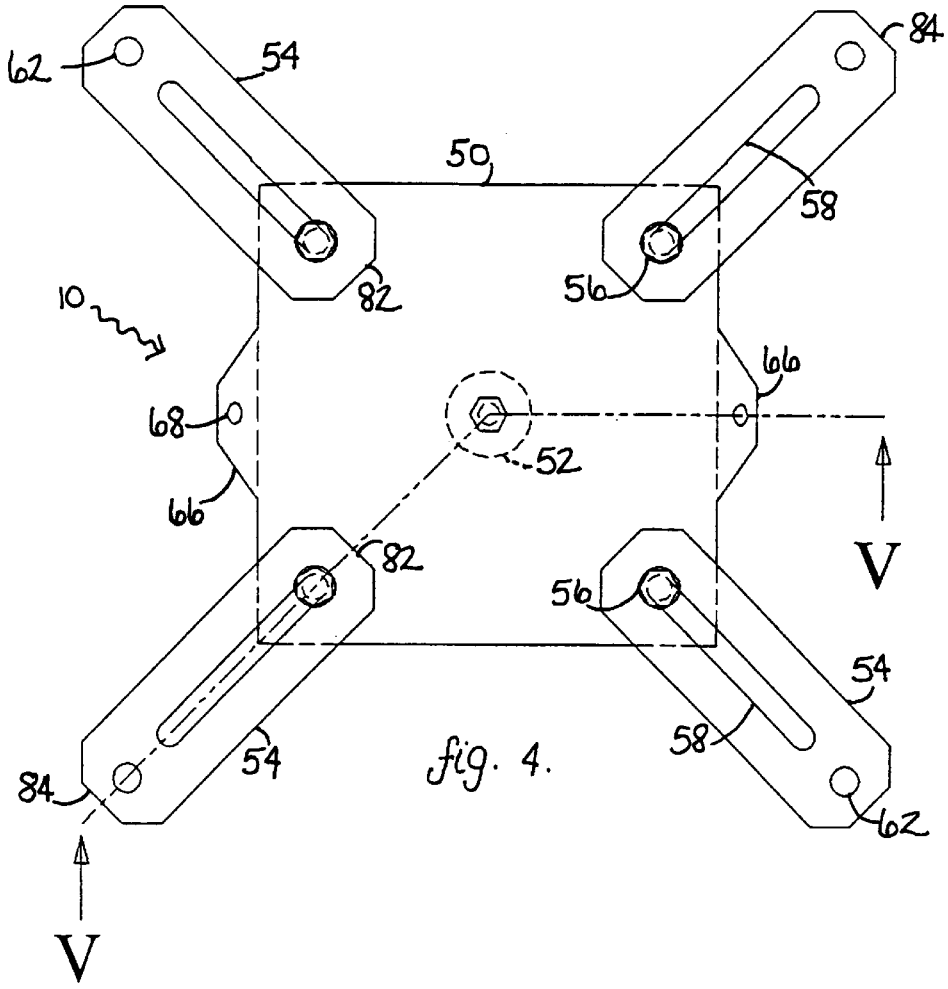
FIG. 4 is a top plan view of the converter head in accordance with the invention; and, FIG. 5 is an enlarged scale sectional view taken along line V—V in FIG. 4.
Figure 5:
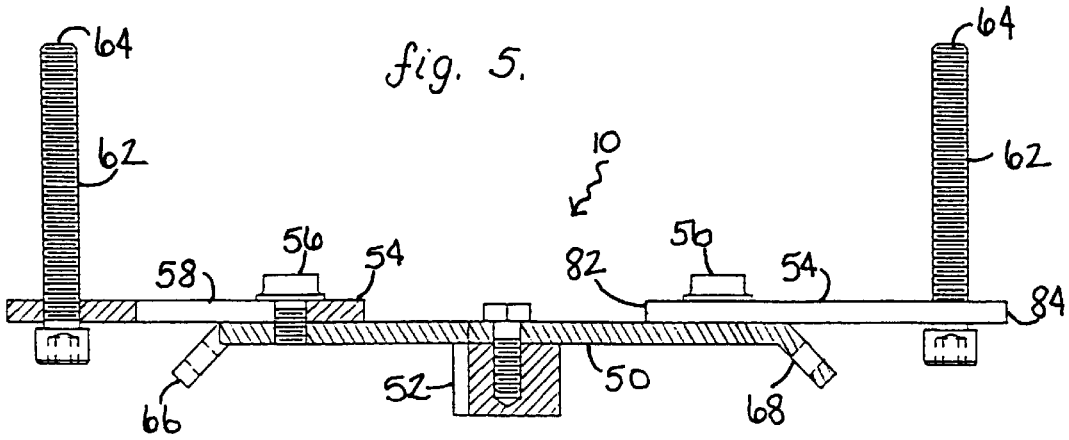

FIGS. 4 and 5 are orthographic views of the converter 10 in accordance with the invention. The converter 10 comprises a base plate 50 that generally defines a plane. The base plate 50 has a changeable stem 52 suspended beneath its center of geometry. The stem 52 is bolted on to the base plate 50, and this allows switching between different sizes of stems 52 (only one size shown) as necessary to match the size of the socket 28 in the seat portion 20 of any given jack (eg., 12 in FIGS. 1–3). Because conventional jacks 12 have sockets 28 of different sizes according to variations among different manufacturers (or different models of the same manufacturer), it is desirable to allow changing the size of the stem 52 to adapt the converter 10 to the specific model of jack. FIG. 3 shows how the base plate 50 appears after being seated onto this representative jack 12 of the prior art. For the purpose of interchangeability between different sizes of stems 52 (only one size shown), the stem 52 is removably attached as by a bolt rather than welded or otherwise permanently attached.

The base plate 50 generally has a square shape and at each corner it carries the four arms 54 spaced as shown. Each arm 54 comprises a slotted bar that extends between a butt end 82 and a tip end 84. The tip end 84 is formed with a threaded hole. Between the tip end 84's threaded hole and butt end 82, each slotted bar 54 is formed with a longitudinal slot 58 that extends substantially between the tip end 84's threaded hole and butt end 82.

Each corner of the base plate 50 has a threaded hole for twisting in and tightening a locking-adjustment bolt 56. Each bar 54 is held to the base plate 50 by one of these locking-adjustment bolts 56 being inserted through the slot 58. When the locking-adjustment bolts 56 are slack, the slotted bars 54 can slide and pivot freely with respect to the locking-adjustment bolts 56. When the locking-adjustment bolts 56 are tightened, they lock the slotted bars 54 tightly in place. Given the foregoing, the tip ends 84 of the slotted bars 54 are variously adjustable in an indefinite number of positions, all of which (ie., these positions) are contained substantially in the plane of the base plate 50. The threaded holes in the tip ends 84 of the arms 54 carry the cap screws or "fingers" 62. The cap screws 62 are inverted as shown.

One example size of the converter 10 can include without limitation the following dimensions. The slots 58 can be sized to allow about four-and-one-half inches (11 cm) travel. The cap-screw fingers 62 can measure having a four inch grip length by one-half inch diameter (102 mm×13 mm-diam.) The distance between diagonally opposite fingers 62, extended to the extreme as shown in FIG. 4, might be about eighteen inches (45 cm). However, the arms 54 are adjustable to an indefinite number of positions so that other configurations and measures are possible and desirable. For example, two adjacent arms 54 can be pivoted into each other to form a vertex such that the distance between the fingers 62 thereof might measure no more than about one-and-one-half inches (3.8 cm), or perhaps even less (although collapsing two fingers 62 to less than one-and-one-half inches apart has no real practical use in the work of transmission servicing). Alternatively, two adjacent arms 54 can be pivoted straight opposite to each other (ie., they are contained by a common line extending along the intervening edge of the base plate 50) such that the fingers 62 thereof measure about sixteen inches (40 cm) apart. However, these measures are given mention here merely for convenience in this description and are not limiting because the converter 10 can be scaled during design and fabrication to any given size as desired.

The base plate 50 includes opposite inclined flanges 66 formed with eyes 68. Each eye 68 allows the insertion therethrough of a bolt, a chain-hook, or a J-bolt (none shown in FIGS. 4 or 5, but see the J-bolt 74 in FIGS. 1 though 3), and so on. With continued reference to FIGS. 1–3, in use, for example, a length of chain 72 is looped over a "waist" portion of the transmission 40. One tag end of the chain may be anchored to one eye 68 in the base plate 50 by means of a simple nut and bolt 76. The other side of the chain 72 may have the hook end of the J-bolt 74 inserted through any given link of the chain 72. The thread-portion of the J-bolt 74 would then be inserted through the eye 68 of the opposite-side inclined flange 66. The tightness of the chain 72 is adjusted by turning the nut on the J-bolt 74 to draw the chain 72 circumferentially tighter around the waist of the transmission 40.

The base plate 50 and arms 54 preferably are made from high-grade plate steel which allow fabrication of screw-thread therein. The cap screws 62 are preferably standard high-grade tool steel machine screws. The stem is preferably formed from round stock steel which also allows fabrication of screw-thread therein.

The invention having been disclosed in connection with the foregoing variations and examples, additional variations will now be apparent to persons skilled in the art. The invention is not intended to be limited to the variations specifically mentioned, and accordingly reference should be made to the appended claims rather than the foregoing discussion of preferred examples, to assess the scope of the invention in which exclusive rights are claimed.

We claim:

1. In combination with a low-clearance general service hydraulic jack and a cup head of which:

the low-clearance general service hydraulic jack is of the type having: a low, wheeled frame; a handle operatively connected to the frame near one a rear end thereof and disposed rearwardly of the said rear end; a boom extending between a base end pivoted to the frame near the handle connection and an opposite end formed with a seat portion; and a hydraulic cylinder which stretches between the frame and the boom nearly extensively with the boom and which is actuated by pumping the jack handle through a pumping arc anywhere between extremes of about 12 o'clock and 3 o'clock as rearwardly of the rearend of the low wheeled frame to raise the seat portion of the boom; the hydraulic cylinder being sized to give the boom at least about a two (2) ton lifting capacity: wherein the seat portion is formed with a socket for accepting removable seating of a given head; and the cup head is of the type having a stem for removable seating in the socket of the seat portion:

an improvement compising:

a converter head comprising: a base plate defining a plane: a stem suspended beneath the base plate for removable seating in the socket of the seat portion wherein the vertical drop of the converter-head's stem during seating of the converter head is stopped substantially by the base plate thereof landing on the seat portion of the boom: a plurality of arms, each extending between a butt end and a tip end; lockable-adjustable means for adjustably mounting the arms to the base plate such that the tip ends can be located in various positions substantially in the plane of the base plate and for locking the arms in positions; and a finger, carried by the tip end of each arm, each finger for providing an upper contact end for propping a vehicle transmission thereon;

wherein swapping back and forth between the cup head and the converter head allows a user to convert the jack reversibly between a non-specialized, general service variety into as for tipping up car bodies, and, a special transmission jack for propping up dropping out and servicing transmissions;

wherein the base plate has lateral left and right edges along which each is formed with means for securing a chain, the improvement further comprising a chain for looping around a waist of a transmission propped by the fingers of the converter head, which chain is secured at opposite places by the chain securing means:

wherein the chain-securing means comprises eyes formed in the base plate and one of bolts or hooks extending through the eyes for inserting through links of the chain: and, wherein the base plate comprises a pair of inclined down flanges, one each at the lateral left and right edge respectively of the base plate, wherein the eyes are formed in the inclined down flanges so that the one of bolts or hooks should extend up through eyes, as for insertion through links of the chain loop around the waist of the transmission propped upon the fingers, in such directions away from the inclined flanges as to spread wide and hence accommodate transmissions having waists having relatively large circumferences.

2. The combination of claim 1 further comprising reversible-foreshortening means for the fingers for reversibly foreshortening the length of the fingers.

3. The combination of claim 2 wherein the arms comprises bar stock, the fingers comprise cap screws, and the reversible-foreshortening means comprises threaded holes at the tip ends of the arms in which the cap screws are inserted wherein twisting any cap screw changes the length of that finger.

4. The combination of claim 1 wherein each arm comprises bar stock formed with a central slot therein, and the lockable-adjustable means comprises threaded-holes formed in the base plate and bolts extending through the slots of the bars and inserted in the threaded holes of the base plate for tightening and locking the bars in place.

5. The combination of claim 1 wherein the base plate is provided with four arms.

6. The combination of claim 1 wherein the cup head comprises an enlarged-size dish head from which the stem thereof is suspended.

* * * * *